United States Patent [19]

Hoefkes

[11] Patent Number: 5,026,011

[45] Date of Patent: Jun. 25, 1991

[54] PEG BOARD HANGER

[76] Inventor: Heiner J. Hoefkes, 4218 Melia Drive, Mississauga, Canada, L5C 4J5

[21] Appl. No.: 581,531

[22] Filed: Sep. 12, 1990

[51] Int. Cl.[5] ..... A47B 5/00

[52] U.S. Cl. ..... 248/220.4

[58] Field of Search ..... 248/220.3, 220.4, 221.1, 248/221.2, 222.2, 224.4, 225.2, 303, 304; 211/70.6, 106

[56] References Cited

U.S. PATENT DOCUMENTS

| | | | |
|---|---|---|---|
| 2,884,221 | 4/1959 | Messier | 248/221.1 |
| 3,501,015 | 3/1970 | Behles | 248/220.4 |
| 3,669,034 | 6/1972 | Marschak | 248/221.1 |
| 3,709,452 | 1/1973 | Feeny | 248/221.1 |
| 4,344,540 | 8/1982 | Marschak | 248/220.3 |

FOREIGN PATENT DOCUMENTS

| | | | |
|---|---|---|---|
| 1230105 | 12/1987 | Canada . | |
| 1473045 | 2/1967 | France | 248/222.2 |

*Primary Examiner*—Ramon O. Ramirez
*Assistant Examiner*—Robert A. Olson

[57] ABSTRACT

A peg board hanger is designed to provide ends which attach to the peg-board where both ends curve through 90° in a plane perpendicular to the downward extent of the hanger.

6 Claims, 5 Drawing Sheets

PEG BOARD HANGER

This invention relates to peg-board hangers for attachment to the holes in the peg-board and designed, when so hanging, to support tools or other articles thereon.

The peg board hanger may be used not only with peg-board but with any other board or sheet or any material having a pair of spaced holes where the hanger may attach in a similar manner to peg-board.

In my Canadian Pat. No. 1,230,105 dated Dec. 8, 1987 I disclosed a peg-board hanger which was useful and efficient for supporting a wide range of articles. The hanger was a single piece of stiffly resilient wire and was hung adJacent each free end at a curved length which extended upwardly then through the peg-board and downwardly, in the rest position of the peg-board. Although the design was quite effective the retention of the hanger to the board depended on a degree of interference between hanger and board. This rendered the hanger tolerances too critical for easy manufacture and often necessitated a tool for removal and sometimes for attachment of the hanger to the board. Other hangers for peg-board have suffered from the same disadvantages or from the disadvantage that the hanger was too easily detached under vibration or impact.

Accordingly it is an object of my invention to provide a hanger mode of stiff resilient wire dimensioned (that is, of a diameter) to pass through holes in the peg board, having two extents for disposition approximately parallel to the board on the front side thereof, and two free ends on respective extensions, for extension through the peg board and where, in a rest attitude of the hanger the extensions each curve in a plane perpendicular to the longitudinal axis of the extension to which they are attached.

It is an object of the invention to provide a peg-board hanger of a single length of resilient wire adapted in a rest position to extend (usually downwardly) from two spaced respective attachment locations to meet at a bight and having tool support means located between said attachment means and said bight with an extent on each leg adjacent the attachment point adapted to extend outside and approximately parallel to said peg board in said rest position, with attachment means in the form of an extension from the outer end of such extent and approximately perpendicular thereto adapted to extend through a peg board aperture in said rest attitude, and when so extending, shaped rearwardly of said peg board to extend in a curve of approximately 90° to a free end, the curve being in a plane perpendicular to said extent and both curves being in the same sense. A hanger is thereby provided which is convenient to attach and detach (generally) with a snap action but is secure against accidental detachment such as by impact or vibration. At the same time as the description of the specific embodiment herein will show, the novel hangar includes the versatility and features of the hanger shown in Canadian Pat. No. 1,230,105.

An object of a preferred aspect of the invention is to provide a hanger constructed of a length of stiffly resilient wire adapted to hang from the peg board in a rest attitude, having two free ends for attachment to the peg board, the wire adjacent each free end having an extent defining a longitudinal axis adapted to be approximately parallel to the peg-board and a curved extension of said extent located in a plane approximately perpendicular to said axis and adapted, in said rest position to extend and curve in the same sense as the other extension and through approximately 90°. The hanger thus designed which is secure against accidental detachment but convenient to attach and detach. At the same time, the hanger so designed may be shaped to provide the versatility and features of the hanger shown in Canadian Pat. No. 1,230,105.

In drawings which show a preferred embodiment of the invention:

Figure 1:
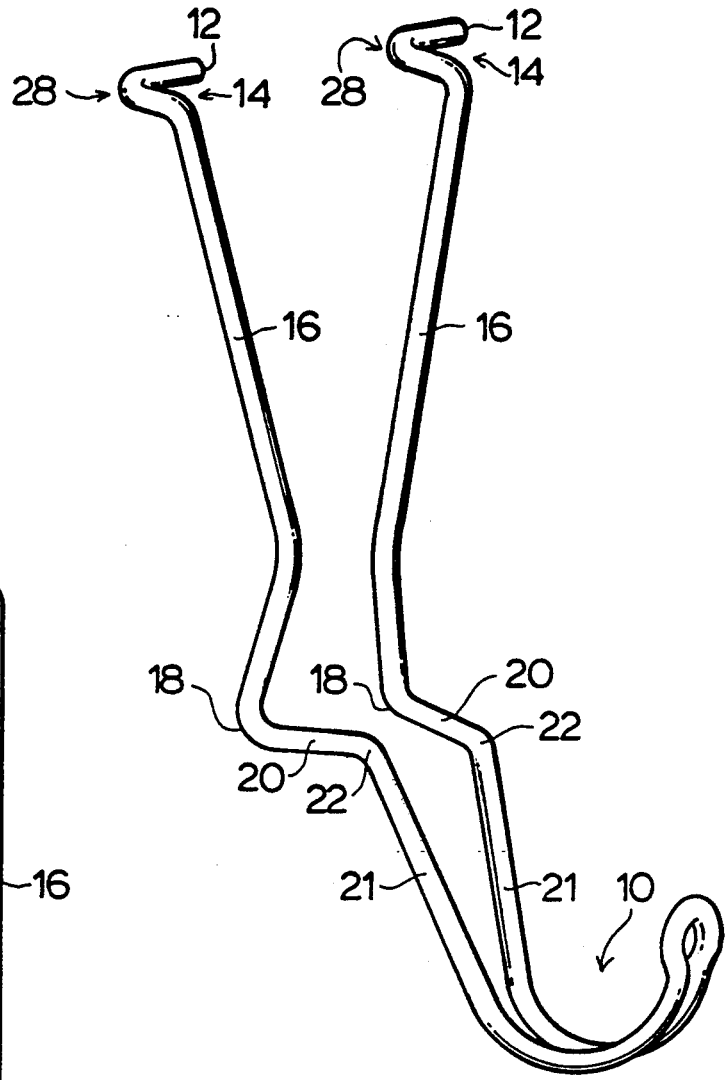
FIG. 1 is a perspective view of a hanger in accord with the invention.

In the drawings the hanger shaped as shown is constructed of a single length of stiffly resilient wire which can be considered as two legs meeting at a bight and both legs are preferably side by side in the vicinity of the bight.

Figure 9:
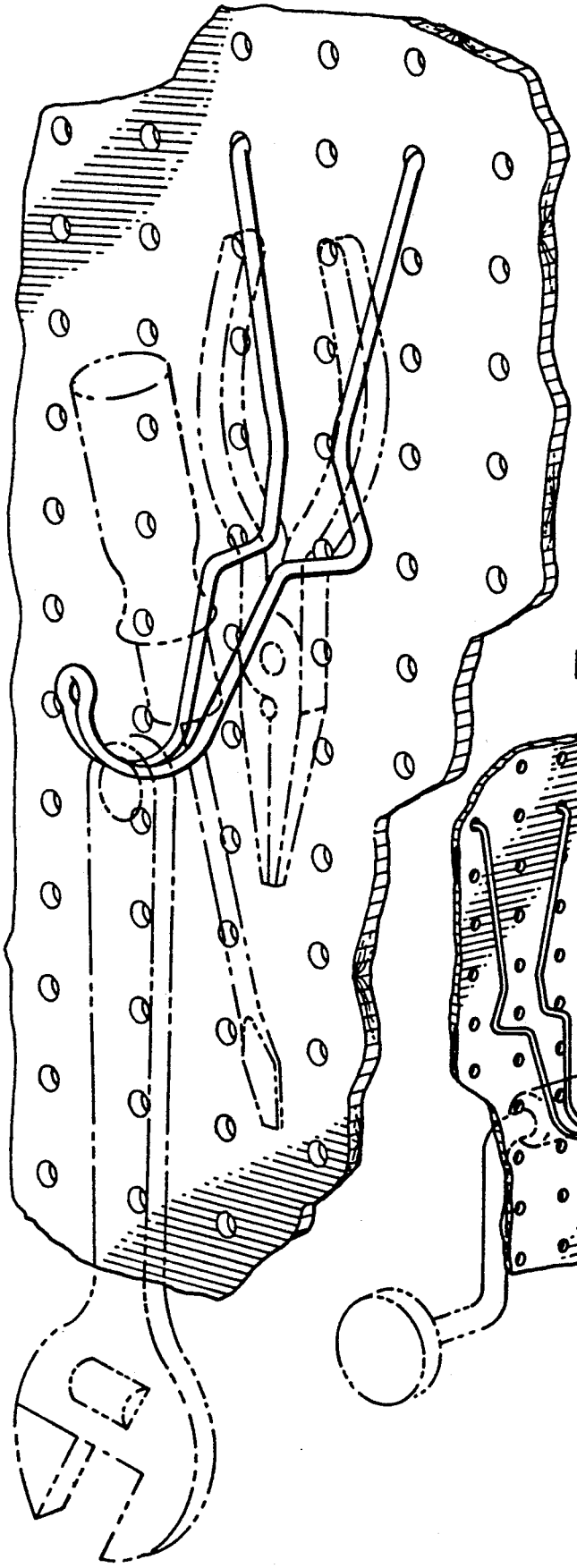
FIGS. 9 and 10 show the hanger in use.

The bracket comprises attachment means 14, to be described hereafter, to suspend the bracket adjacent the free ends 12. An extent 16 of each leg extends (usually downwardly) from the attachment means and contacts the front of the board at 18 in what is called the "rest position" of the hanger, shown in FIGS. 1–3, 9 and 10. At the lower end of each extent 16 bend 18 provides an outwardly directed length 20. At the outer end of length 20 a bend 22 in the opposite direction from bend 18 of preferably just less than 90° supplies an outward and downward extent 21 terminating an upturned hook and bight 10. As best illustrated in FIG. 9 the legs on each side of bend 18 are shaped, in the unstressed attitude of the legs, to space the bends 18 of the two legs a considerably greater distance than the spacing of the length 27 adjacent the bight 10 and wider (when the hanger is unattached to the board) than that of extents 16 adjacent attachment means 14. The result is that the lengths 20 projecting from the board, in the rest position of the hanger, converge more sharply toward knee 22 than they converge in the length below the knee 22 in any attitude of the legs. This is best shown in FIG. 9 and greatly increases the variety of tools (such as the pliers and screwdrivers of FIG. 9) which the inventive bracket will hold on its projecting extents.

Figure 4:
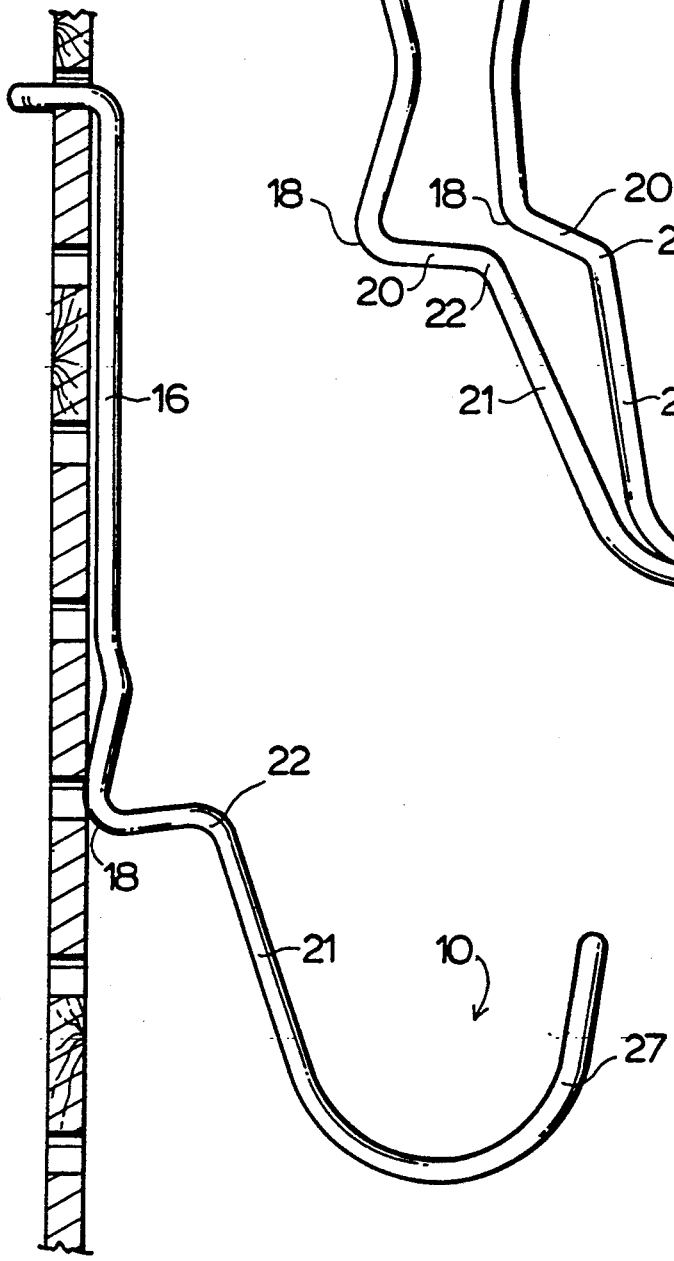
FIG. 4 is a vertical section along the lines 4—4 of FIG. 2, FIGS. 5–8 are views illustrating the mode of attachment of the inventive hanger.
Figure 2:
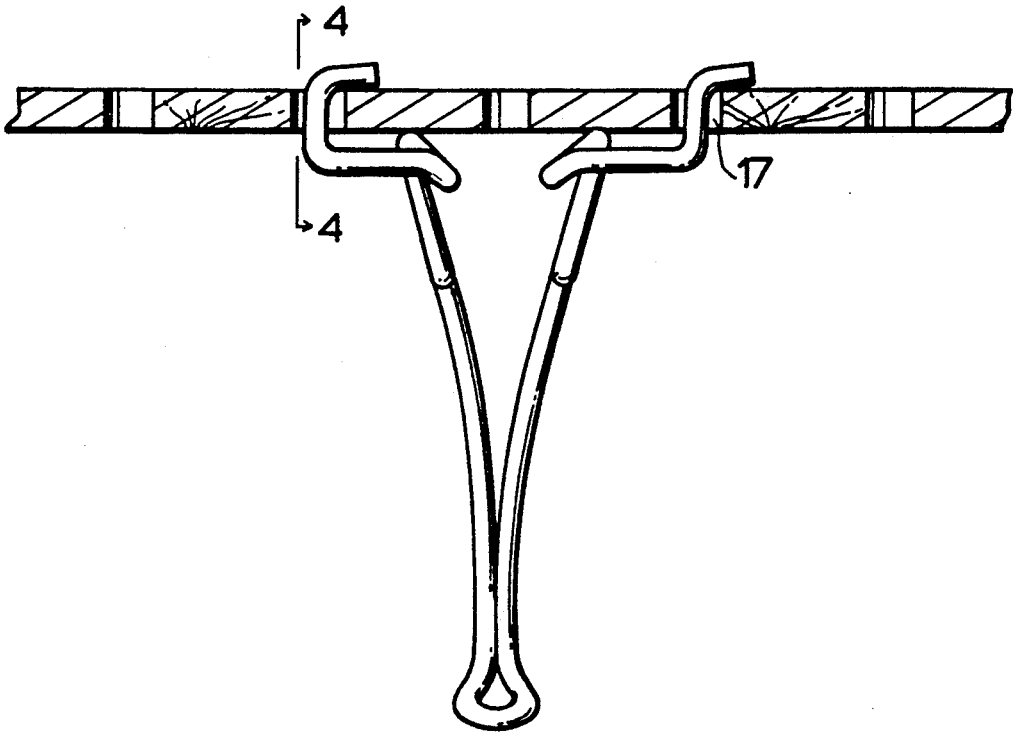
FIG. 2 shows a plan view of the hanger of FIG. 1 attached to spaced peg board holes.
Figure 3:
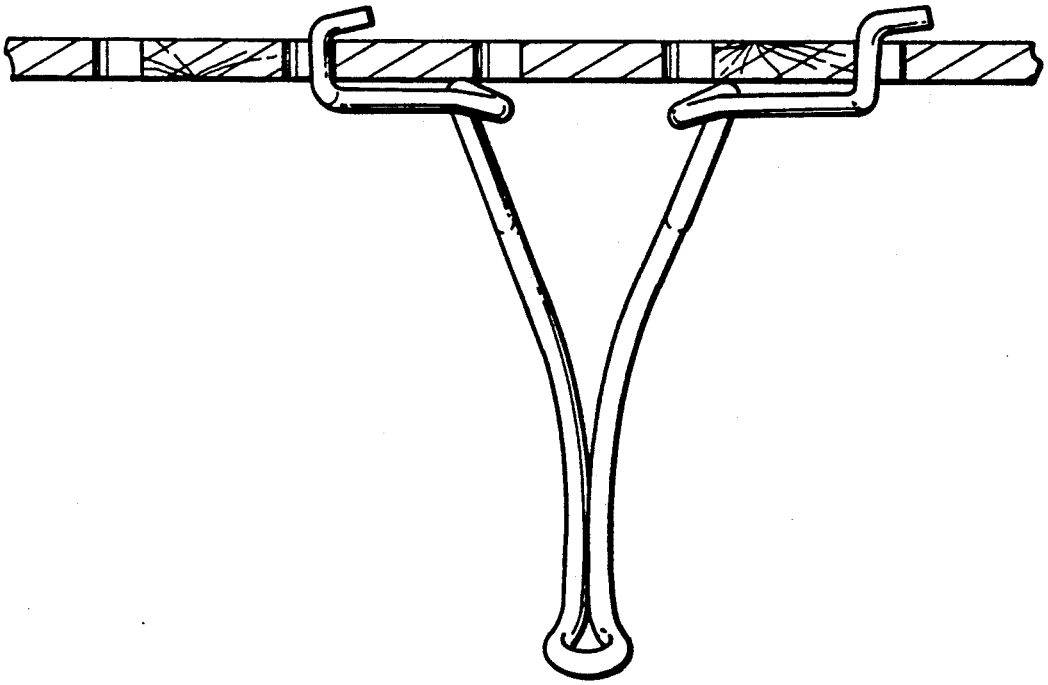
FIG. 3 is a similar view to FIG. 2 with different hole spacing.

The attachment means 14 comprise an extension 28 from the upper end of extent 16 the extension 28 is perpendicular to the longitudinal axis of extent 16 and is shaped and dimensioned to extend through a board aperture and curve through an angle of approximately 90°. The extension 28 including its curve is directed in a plane approximately perpendicular to the axis of plane 16 (as best shown in FIG. 4) and both curves are in the same sense.

The sense of the two curved extensions relative to the extents 16 must be the same, that is both to the right (as shown), looking toward the board, or both to the left.

Figure 5:
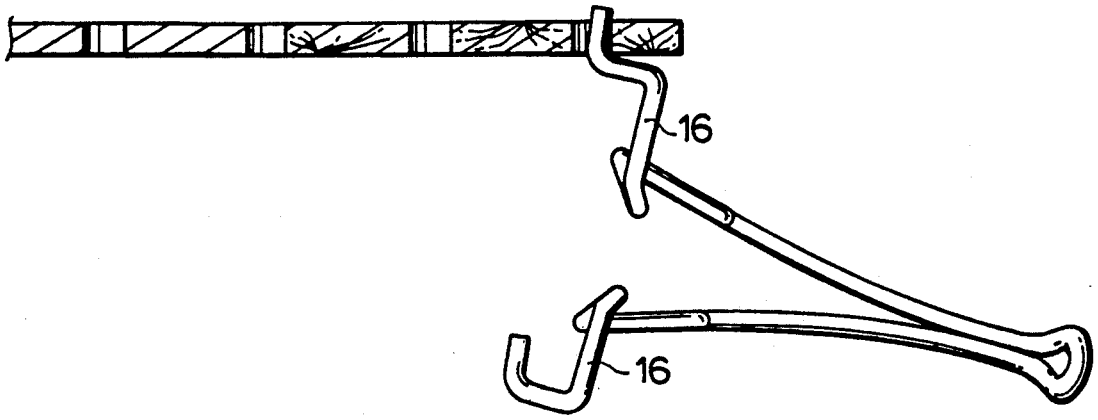
Figure 6:
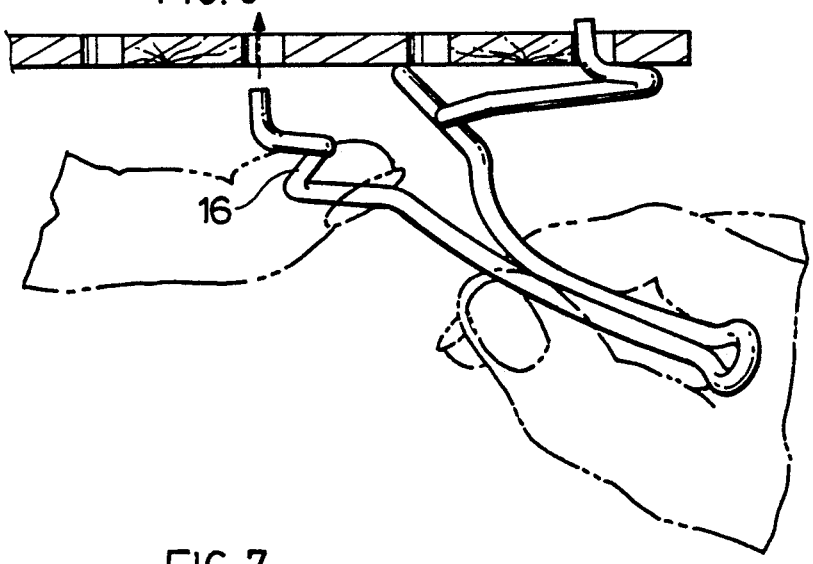
Figure 7:
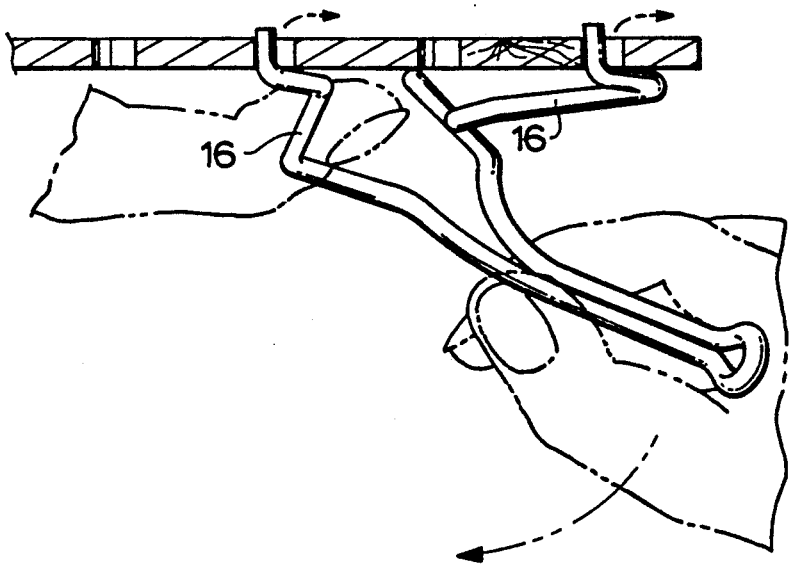
Figure 8:
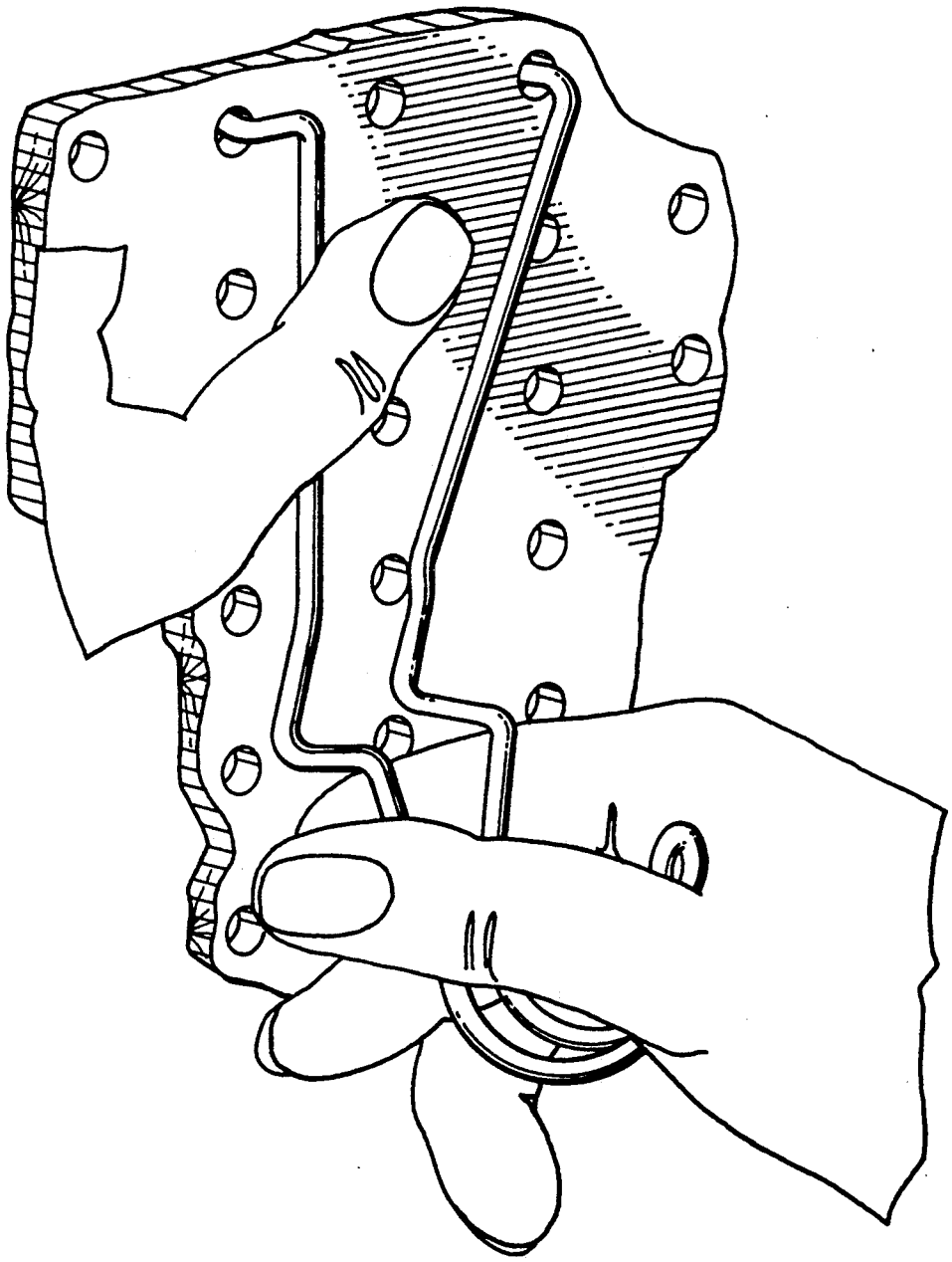
Figure 10:
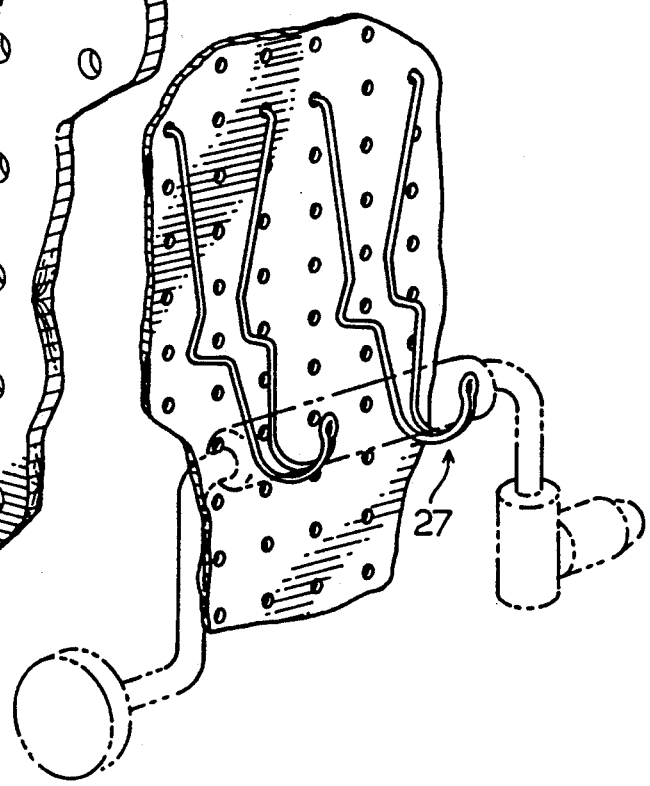

In use: the extent 16 on the side corresponding to the sense of the extension curve (i.e. the right-hand extent of FIGS. 1 and 5 is inserted in its selected hole 17 by first rotating the hanger so that the free end and the outer part of the extension may be inserted in the (right hand) selected hole (FIG. 5). The hanger is then rotated through 90° which places the free end of the right-hand extension behind the peg board and the left-hand extent in contact or nearly in contact with the front of the board. The hanger is then manually distended and oriented so that the free end of the left-hand leg is centred over the selected left-hand hole. The free end and extension 16 then wrongly directed for entry. The operator then maintains the left-hand extension 16 approximately parallel to the peg board while applying torsion to the hanger, (preferably by digitally grasping hook 10) to twist the hanger in a clockwise upward direction until the left-hand free end 12 may be directed through the hole. This tends to require a push to start the left-hand free end through the hole and in this case the insertion involves a snap action. Now when the hanger is released it hangs from the board able to perform its functions as best shown in FIGS. 9 and 10 with the two extensions behind the board securely supporting the hanger.

When it is desired to remove the hanger, torsion in the sense clockwise-upward is applied to the board. This rotates the left-hand extension and tends to move it away from the board causing the left-hand extension to move out of the hold with a snap action. The right-hand extension may then be simply detached.

It is possible to so carefully manipulate the hanger for both attachment and detachment that there is no snap action although this becomes more difficult the smaller the dimensional differential between hole and wire diameter. However with most normal use there is a snap action on both insertion and removal of the left-hand attachment means from the board.

The hanger is shown as passing through two holes of the same height. If desired, however the hanger may extend between two holes of different heights.

The extensions may each curve to the left instead of to the right as shown. The left-hand extension is then inserted first and the right-hand extension inserted (with right-hand extent parallel to the board) after rotating the hanger counter-clockwise-upward. To remove the hanger it is rotated counter-clockwise-upward until the right-hand extension snaps out of the hole. The previous description therefore must be read with the substitution of left for right, counter-clockwise for clockwise.

In either alternative the hanger is relatively easy to insert and withdraw with a snap-action in the withdrawal and usually a snap action in the application.

I claim:

1. A peg-board hanger comprising stiffly resilient wire legs of a diameter to pass through holes in said peg-board adapted in a rest position to extend downwardly from respective attachment locations to meet at a bight and having tool support means located between said attachment means and said bight, an extent on each leg adjacent the attachment point adapted to extend outside and approximately parallel to said peg board in said rest position, attachment means comprising an extension from the upper end of each such extent and approximately perpendicular thereto adapted to extend through a peg board aperture in said rest position, and when so extending, shaped, rearwardly of the peg board, to curve approximately 90° to a free end, the curve being in a plane perpendicular to said extent, the curve of each extension being in the same sense.

2. A hanger as claimed in claim 1 including means, when at least the extension of the extent of said hanger on the side corresponding to the sense of said curvature is extending through a hole in the peg board and the other extend is adjacent said peg board, of applying torsion to said hanger in the direction opposite to said sense.

3. A peg-board hanger constructed of a length of stiffly resilient wire of a diameter to pass through a hole of said peg-board adapted to hang in a rest attitude relative to the peg board having two free ends, the wire adJacent each free end having an extent defining a longitudinal axis adapted when attached to said peg board to lie approximately parallel to the peg-board, a curved extension from each said extent to one of said free ends located approximately in a plane perpendicular to the said axis and adapted in said rest position to extend through said peg-board and curve in the same sense as the other extension through an angle of approximately 90°.

4. A hanger as claimed in claim 3 including means, when at least the extension of the extent of said hanger on the side corresponding to the sense of said curvature is extending through a hole in the peg board and the other extend is adjacent said peg board, of applying torsion to said hanger in the direction opposite to said sense.

5. A peg board hanger constructed of a length of stiffly resilient wire having a diameter to pass through holes in said peg board and adapted to hang in a rest attitude relative to the peg board, having two free ends for attachment to the peg board, the wire adjacent the free ends having an extent defining a longitudinal axis and curved extensions between each extent and a free end, both extensions curving in the same sense in a plane approximately perpendicular to the respective extend and dimensioned to pass through a hole in said peg board with the free end therebehind.

6. A hanger as claimed in claim 5 including means, when at least the extension of the extent of said hanger on the side corresponding to the sense of said curvature is extending through a hole in the peg board and the other extend is adjacent said peg board, of applying torsion to said hanger in the direction opposite to said sense.

* * * * *